US008074482B2

(12) United States Patent
Okui et al.

(10) Patent No.: US 8,074,482 B2
(45) Date of Patent: Dec. 13, 2011

(54) PLUG FOR COLD DRAWING AND METHOD FOR MANUFACTURING OF METAL PIPE

(75) Inventors: Tatsuya Okui, Osaka (JP); Kouichi Kuroda, Osaka (JP); Tadashi Kawakami, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 191 days.

(21) Appl. No.: 12/691,503

(22) Filed: Jan. 21, 2010

(65) Prior Publication Data

US 2010/0170316 A1 Jul. 8, 2010

Related U.S. Application Data

(63) Continuation of application No. PCT/JP2008/063788, filed on Jul. 31, 2008.

(30) Foreign Application Priority Data

Aug. 10, 2007 (JP) ..... 2007-208908

(51) Int. Cl.
*B21C 1/24* (2006.01)

(52) U.S. Cl. ..... 72/283; 72/370.01; 72/370.02

(58) Field of Classification Search ..... 72/97, 208, 72/209, 274, 283, 370.01, 370.02, 370.1, 72/370.13, 370.14, 370.25, 476
See application file for complete search history.

(56) References Cited

U.S. PATENT DOCUMENTS

| | | | | |
|---|---|---|---|---|
| 4,745,787 | A * | 5/1988 | Sansome et al. | 72/41 |
| 6,029,714 | A * | 2/2000 | Imamura et al. | 138/177 |
| 7,788,957 | B2 * | 9/2010 | Okui et al. | 72/97 |
| 2006/0218985 | A1 * | 10/2006 | Kenmochi et al. | 72/284 |

FOREIGN PATENT DOCUMENTS

| | | |
|---|---|---|
| JP | 02-197313 | 8/1990 |
| JP | 09-155414 | 6/1997 |
| JP | 11-300411 | 11/1999 |
| JP | 2006-167763 | 6/2006 |
| RU | 2030941 C1 | 3/1995 |

OTHER PUBLICATIONS

International Search Report in corresponding PCT/JP2008/063788 dated Aug. 26, 2008.

* cited by examiner

*Primary Examiner* — Edward Tolan
(74) *Attorney, Agent, or Firm* — Marshall, Gerstein & Borun LLP

(57) ABSTRACT

A plug 1 includes a first columnar portion 20, a tapered portion 30, and a second columnar portion 40. The first columnar portion 20 has an outside diameter D1. The second columnar portion 40 has an outside diameter D2 which is larger than the outside diameter D1. The tapered portion 30 is formed between the first columnar portion 20 and the second columnar portion 40. The tapered portion 30 has a tapered surface 31 provided with an outside diameter which is gradually increased from the first columnar portion 20 to the second columnar portion 40, and an axial direction length L. The outside diameters D1 and D2, and the axial direction length L meet the following expressions (1) to (4):

$$0.25 \leqq \rho \leqq 2.00 \quad (1),$$

$$0.06 \leqq L/D2 \leqq 0.8 \quad (2),$$

$$L/D2 \leqq 0.3 \times \rho + 0.575 \quad (3), \text{ and}$$

$$L/D2 \geqq 0.1 \times \rho \quad (4)$$

where $\rho = (D2 - D1)/D1 \times 100$.

Therefore, the cold drawing plug according to the present invention can reduce the tensile residual stress on the outer surface of a metal pipe after the cold drawing.

4 Claims, 5 Drawing Sheets

PLUG FOR COLD DRAWING AND METHOD FOR MANUFACTURING OF METAL PIPE

TECHNICAL FIELD

The present invention relates to a plug and a method for manufacturing of metal pipes, and more particularly, relates to a plug for use in cold drawing, and a method for manufacturing of metal pipes using the same.

BACKGROUND ART

Metal pipes are sometimes subjected to cold drawing in order to improve the dimensional accuracy thereof or smooth the inner and outer surfaces thereof. For cold drawing, a die and a plug are generally used. The die reduces the diameter of a metal pipe to adjust the outside diameter of the metal pipe to a desired dimension. Further, the die smoothes the outer surface of the metal pipe. On the other hand, the plug adjusts the inside diameter dimension of the metal pipe, and smoothes the inner surface of the metal pipe.

In recent years, for the plug for use in cold drawing, various types of geometry according to purposes have been proposed. For example, JP2006-167763A and JP11-300411A disclose protruding ring plugs which are intended to remove the wrinkle flaw on the inner surface of a metal pipe, the workpiece, (hereinafter to be called a hollow shell). With the protruding ring plugs disclosed in these Patent Documents, a ring-shaped projection is formed in the rear portion of the plug, the projection providing a step height on the plug surface. By the use of this step height, the hollow shell inner surface is subjected to ironing. Thereby, the wrinkle flaw on the hollow shell inner surface is removed and the surface roughness is improved.

In cold drawing, the outer surface of the metal pipe after the drawing often has tensile residual stresses in the circumferential direction. If the outer surface of the metal pipe has a dent flaw, the mutual action between the dent flaw and the tensile residual stress may cause a crack to occur on the outer surface of the metal pipe at the time of heat treatment which is carried out after the cold working. Therefore, it is preferable that the tensile residual stress on the outer surface of the metal pipe after the cold drawing be the smallest possible.

JP2-197313A discloses a method for manufacturing of metal pipes that reduces the residual stress and improves the internal pressure fatigue characteristics of the metal pipe. The method of this Patent Document adopts a plug of a two-step construction, in which the rear half portion of the plug has an outside diameter larger than that of the front half portion of the plug. Using this plug, the hollow shell whose diameter has been reduced by the die is expanded at a expansion ratio of 0.1 to 1.5%. Thereby, the residual stress in the metal pipe after the cold drawing is changed, the internal pressure fatigue characteristics being improved.

However, if the expansion ratio is only defined as 0.1 to 1.5% as disclosed in JP2-197313A, the tensile residual stress on the outer surface of the metal pipe may not be able to be reduced, although the residual stress in the metal pipe is changed.

DISCLOSURE OF THE INVENTION

It is an object of the present invention to provide a plug for cold drawing that is capable of reducing the tensile residual stress on the outer surface of a metal pipe after the cold drawing.

The present inventors have thought of adopting a plug including a first columnar portion 20 having an outside diameter D1, a second columnar portion 40 having an outside diameter D2 larger than the outside diameter D1, and a tapered portion 30 formed between the first columnar portion 20 and the second columnar portion 40, as shown in FIG. 1, to expand the hollow shell with the tapered portion 30 during the cold drawing, thereby reducing the tensile residual stress on the outer surface of a metal pipe after the cold drawing.

And, the present inventors have presumed the principle on which the plug having a geometry shown in FIG. 1 can reduce the tensile residual stress, as follows. When the hollow shell is expanded by the tapered portion 30, the compressive strain in the circumferential direction due to the elastic recovery of the metal pipe following the plug removal is greater on the inner surface side of the metal pipe than on the outer surface side thereof. Therefore, stresses in the direction of compression act on the outer surface side of the metal pipe. As a result of this, the tensile residual stress in the circumferential direction on the outer surface of the metal pipe is reduced.

The present inventors have thought that, when the tensile residual stress is reduced on such a principle, not only the expansion ratio, but also the axial direction length L of the tapered portion 30 is related to the reduction of tensile residual stress. This consideration is based on the presumption that, if the axial direction length L is varied for a given expansion ratio, the hollow shell is deformed by the tapered portion 30 also in a varying way. Therefore, the magnitude of the stress in the direction of compression that reduces the tensile residual stress is also varied.

On the above presumption, the present inventors used the finite element method to simulate the cold drawing with a plurality of plugs which are different in the pipe expansion ratio ρ (%) defined by the following expression (A) and the value of L/D2:

$$\rho=(D2-D1)/D1\times 100 \quad \text{(A).}$$

And they determined the tensile residual stress on the outer surface of a metal pipe after the cold drawing.

FIG. 2 gives the results of the investigation. In the diagram, the abscissa represents the expansion ratio ρ (%), and the ordinate represents the value of L/D2. In the diagram, a particular figure of plot denotes a specific value of taper half-angle θ of a plug used in the simulation. The value of taper half-angle θ corresponding to a particular figure is given in the legend in FIG. 2. In the diagram, the numerical value given on the side of a particular plot expresses the value of the ratio of the tensile residual stress σ in the circumferential direction on the outer surface of a metal pipe after the cold drawing to the yield stress YS of the hollow shell before the cold drawing, i.e., the value of σ/YS.

Referring to FIG. 2, the present inventors have found that, when the expansion ratio ρ and the value of L/D2 are within the region AR in FIG. 2, in other words, the outside diameters D1 and D2, and the axial direction length L meet the following expressions (1) to (4), the value of σ/YS is reduced to under 0.5 and the tensile residual stress is effectively reduced:

$$0.25\leqq\rho\leqq 2.00 \quad (1),$$

$$0.06\leqq L/D2\leqq 0.8 \quad (2),$$

$$L/D2\leqq 0.3\times\rho+0.575 \quad \text{(3), and}$$

$$L/D2\geqq 0.1\times\rho \quad (4).$$

On the basis of the above-described finding, the present inventors have made the following invention.

A plug according to the present invention is used for cold drawing of metal pipes. The plug according to the present invention includes a first columnar portion, a second columnar portion, and a tapered portion. The first columnar portion has an outside diameter D1. The second columnar portion is formed coaxially with the first columnar portion. The second columnar portion has an outside diameter D2 which is larger than the outside diameter D1. The tapered portion is formed between the first columnar portion and the second columnar portion. The tapered portion has a tapered surface provided with an outside diameter which is gradually increased from the first columnar portion to the second columnar portion, and an axial direction length L. The outside diameters D1 and D2, and the axial direction length L meet the following expressions (1) to (4):

$$0.25 \leqq \rho \leqq 2.00 \quad (1),$$

$$0.06 \leqq L/D2 \leqq 0.8 \quad (2),$$

$$L/D2 \leqq 0.3 \times \rho + 0.575 \quad (3), \text{ and}$$

$$L/D2 \geqq 0.1 \times \rho \quad (4).$$

where $\rho = (D2 - D1)/D1 \times 100$.

Preferably, a connection portion of the tapered surface that is connected to the end edge of the first columnar portion is smoothly curved in a concave shape.

In this case, the possibility of the plug being damaged if an excessive load is imposed on the connection portion between the first columnar portion and the tapered portion can be minimized.

A method for manufacturing of a metal pipe according to the present invention includes the steps of inserting one end of a hollow shell into the die; inserting the plug for cold drawing into the hollow shell from the second columnar portion toward the direction of drawing; and cold-drawing the hollow shell while holding the plug for cold drawing at a predetermined position.

In this case, the tensile residual stress in the circumferential direction on the outer surface of a metal pipe manufactured can be reduced.

BEST MODE FOR CARRYING OUT THE INVENTION

Figure 1:
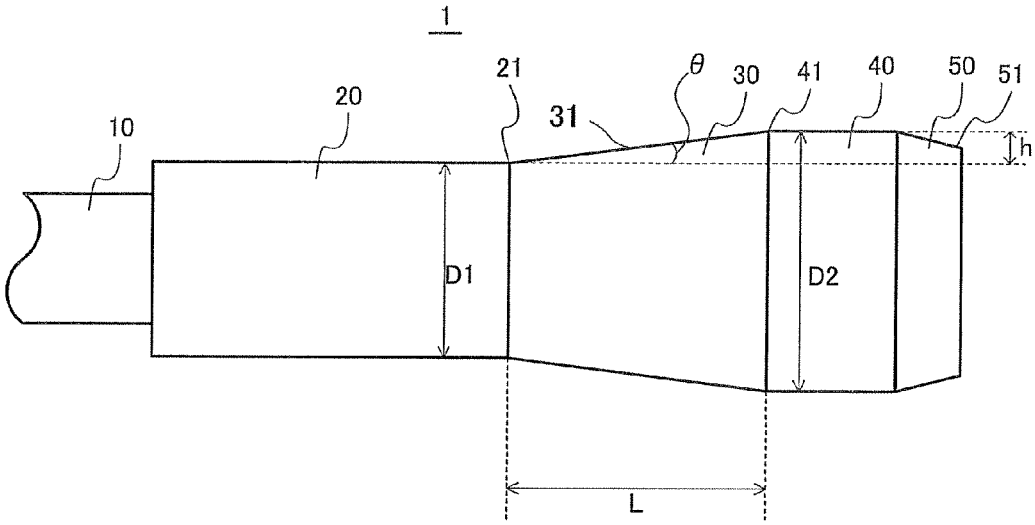
FIG. 1 is a side view of a plug for cold working according to an embodiment of the present invention.
Figure 2:
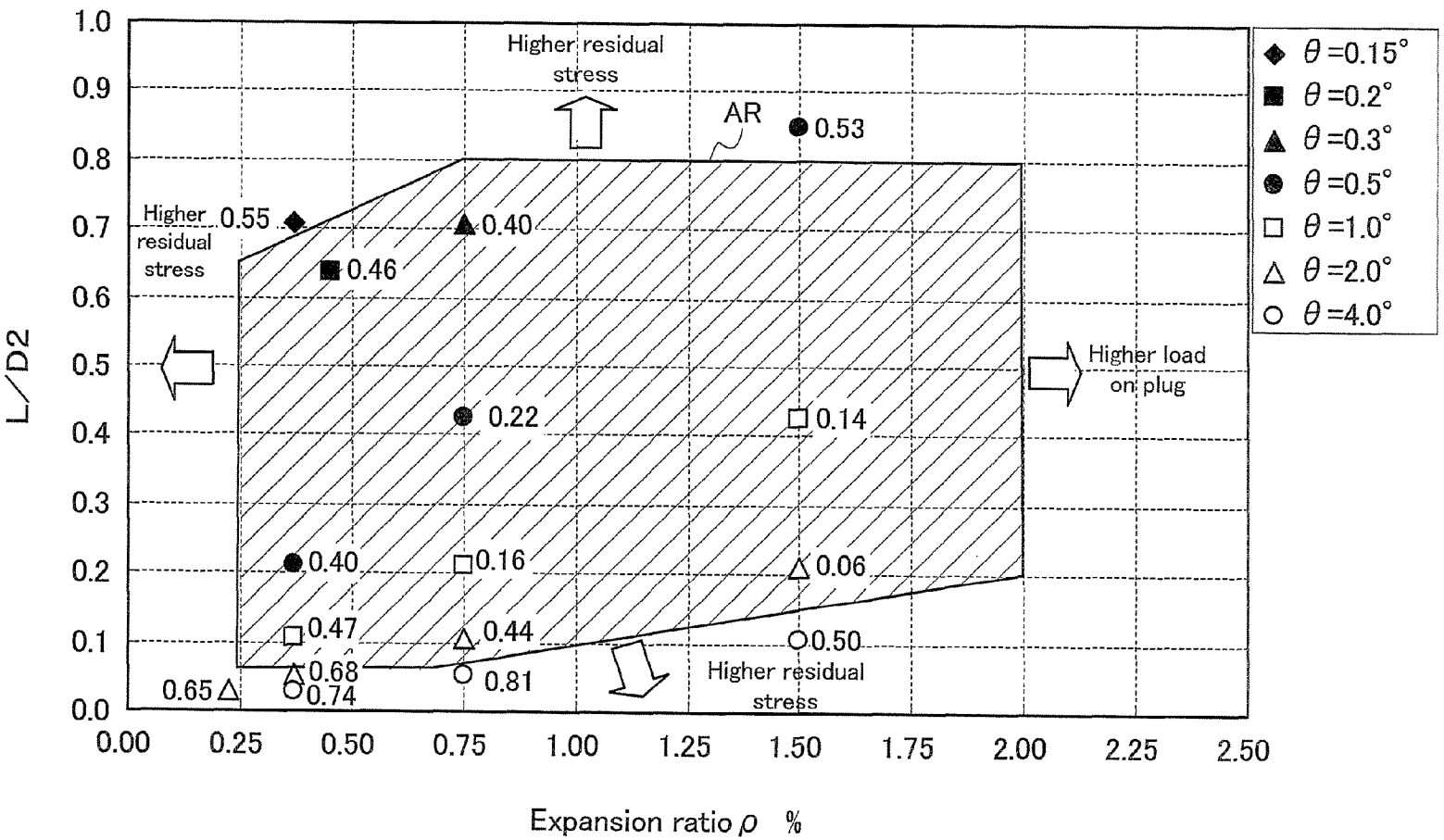
FIG. 2 is a diagram illustrating the relationship among the expansion ratio, the length of the tapered portion of the plug, and the tensile residual stress after the cold drawing when a metal pipe is cold-drawn using the plug for cold working shown in FIG. 1.

Hereinbelow, an embodiment of the present invention will be described in detail with reference to the drawings. The same or corresponding portions in the drawings are provided with the same reference numerals, and the description thereof will not be repeated.

Plug for Cold Drawing

A plug for cold drawing according to the embodiment of the present invention (hereinafter referred to simply as plug) is used for cold drawing of a metal pipe. Hereinafter, a workpiece before cold drawing and that during cold drawing will be referred to simply as a "hollow shell". A workpiece after the cold drawing will be referred to simply as a "metal pipe".

Referring to FIG. 1, a plug 1 includes a first columnar portion 20, a tapered portion 30, a second columnar portion 40, and a relief portion 50. These are coaxially and continuously formed.

The first columnar portion 20 has an outside diameter D1 (mm). The front end of the first columnar portion 20 is connected to the end of a rod 10 by a well-known method (for example, fastening). During cold drawing, the rod 10 supports the plug 1 and holds the plug 1 in a predetermined position. At the time of cold drawing, the first columnar portion 20 is brought into contact with the inner surface of a hollow shell, which has been reduced in diameter with a die (not shown), to make the inside diameter of the hollow shell fixed.

The tapered portion 30 is formed between the first columnar portion 20 and the second columnar portion 40. The tapered portion 30 has a tapered surface 31. The tapered surface 31 is formed between the rear end edge 21 of the first columnar portion 20 and the front end edge 41 of the second columnar portion. The tapered surface 31 is in the shape of a truncated cone and has an outside diameter which is gradually increased from the first columnar portion 20 to the second columnar portion 40. The tapered portion 30 has an axial direction length L (mm).

The tapered portion 30 expands a hollow shell which has been reduced in diameter by the die. Thereby, the tensile residual stress on the outer surface of the metal pipe after the cold drawing is reduced.

The second columnar portion 40 is formed coaxially with the first columnar portion 20. The second columnar portion 40 has an outside diameter D2 (mm) larger than the outside diameter D1. The second columnar portion 40 is brought into contact with the inner surface of the hollow shell, which has been expanded by the tapered portion 30, for making the inside diameter of the metal pipe after the cold drawing fixed.

The relief portion 50 is formed at the rear end of the second columnar portion. The relief portion 50 has an inverse tapered surface 51. The inverse tapered surface 51 is in the shape of a truncated cone, and the outside diameter thereof is gradually decreased toward the rear end of the plug 1. The relief portion 50 minimizes the possibility of a flaw occurring on the inner surface of the hollow shell due to the rear end of the plug 1 when the hollow shell is passed through the plug 1. The plug 1 may not have the relief portion 50.

Further, the plug 1 meets the following expressions (1) to (4):

$$0.25 \leqq \rho \leqq 2.00 \quad (1),$$

$$0.06 \leqq L/D2 \leqq 0.8 \quad (2),$$

$$L/D2 \leqq 0.3 \times \rho + 0.575 \quad (3), \text{ and}$$

$$L/D2 \geqq 0.1 \times \rho \quad (4).$$

where ρ is the expansion ratio (%) which is determined by the following expression (A):

$$\rho = (D2 - D1)/D1 \times 100 \quad (A).$$

If the plug 1 meets the expressions (1) to (4), the tensile residual stress is effectively reduced. More specifically, the value of the ratio of the tensile residual stress σ in the metal pipe to the yield stress YS (MPa) of the hollow shell (i.e., the value of σ/YS) can be held to under 0.5. Hereinbelow, the expressions (1) to (4) will be described in detail.

About Expression (1)

The expression (1) defines the range of the expansion ratio ρ. In other word, the expansion ratio ρ represents the magnitude of the step height h between the first columnar portion 20 and the second columnar portion 40. The lower the expansion ratio ρ, the smaller the step height h, and therefore, the smaller the strain which is given to the hollow shell by the tapered portion 30 when it expands the hollow shell. If the strain which is given by the tapered portion 30 is small, the stress which acts in the direction of compression of the metal pipe on the outer surface side thereof will also be small. Therefore, the tensile residual stress on the metal pipe outer surface after the cold drawing will be difficult to be reduced.

On the other hand, if the expansion ratio ρ is high, the step height h will be great. The greater the step height h, the greater the strain which is given by the tapered portion 30 to the hollow shell will be. Therefore, the tensile residual stress will be easy to be reduced. However, if the step height h is too great, the load which is imposed on the plug 1 at the time of cold drawing will be too large.

If the expansion ratio ρ meets the expression (1), an excessive load can be prevented from being imposed on the plug 1, while the tensile residual stress in the metal pipe can be effectively reduced. The lower limit value of the preferable expansion ratio is 0.30%, and the upper limit value of the preferable expansion ratio is 1.00%.

About Expression (2)

The expression (2) defines the range of the value of the ratio of the axial direction length L of the tapered portion 30 to the outside diameter D2 of the second columnar portion 40, i.e., L/D2. If the value of L/D2 is too small, specifically, if the value of L/D2 is smaller than 0.06, the tensile residual stress will be difficult to be reduced. Although the exact reason why it is so is not clear, the following reason can be presumed. It is this: if the value of L/D2 is small, the axial direction length L is short with respect to the outside diameter D2. In this case, the tapered portion 30 locally deforms only the surface layer portion of the inner surface of the hollow shell. Such a local deformation will have no effect on the hollow shell outer surface. Therefore, even if the hollow shell is expanded by the tapered portion 30, stresses in the direction of compression that reduce the tensile residual stress in the metal pipe after the cold drawing is presumedly difficult to occur.

On the other hand, if the value of L/D2 is too large, specifically, if the value of L/D2 exceeds 0.8, the tensile residual stress is also difficult to be reduced. If the value of L/D2 is large, the axial direction length L is long with respect to the outside diameter D2. The longer the axial direction length L, the more uniformly the tapered portion 30 will deform the entire hollow shell. In other words, the hollow shell is uniformly deformed on both the inner surface side and the outer surface side. If there occurs no difference in the degree of deformation between the outer surface side and the inner surface side of the hollow shell, occurrence of stresses which act in the direction of compression of the metal pipe on the outer surface side thereof is presumedly difficult, resulting in the tensile residual stress being difficult to be reduced.

If the value of L/D2 meets the expression (2), the tensile residual stress can be reduced. If the value of L/D2 meets the expression (2), the hollow shell is deformed to a certain degree of depth from the inner surface toward the outer surface, the portion in the vicinity of the outer surface of the hollow shell being not much deformed. Therefore, there arises a difference in the degree of deformation between the inner surface side and the outer surface side of the hollow shell. Such a deformation difference presumedly causes stresses in the direction of compression on the outer surface side of the metal pipe, resulting in the tensile residual stress being reduced. The preferable lower limit value of L/D2 is 0.1, and the preferable upper limit value of L/D2 is 0.3.

About Expressions (3) and (4)

The expressions (3) and (4) define the relationship between the expansion ratio ρ and the value of L/D2.

If the expansion ratio ρ is low and the value of L/D2 is large, resulting in the expression (3) being not met, the taper half-angle θ of the tapered portion 30 is small, and the axial direction length L is long. In this case, the hollow shell is uniformly deformed on both the inner surface side and the outer surface side, resulting in no deformation difference being produced. Therefore, occurrence of stresses in the direction of compression on the outer surface of the metal pipe after the cold drawing is difficult, resulting in the tensile residual stress being difficult to be reduced. If the expression (3) is met, there arises a deformation difference between the inner surface side and the outer surface side of the hollow shell, resulting in stresses occurring in the direction of compression, and thus the tensile residual stress being effectively reduced.

On the other hand, if the expansion ratio ρ is high and the value of L/D2 is small, resulting in the expression (4) being not met, the taper half-angle θ of the tapered portion 30 is large, and the axial direction length L is short. In this case, only the surface layer portion of the inner surface of the hollow shell is locally deformed. Therefore, the effect of the deformation is not transmitted to the hollow shell outer surface, resulting in the tensile residual stress being difficult to be reduced. Further, at the time of cold drawing, an excessive load will be imposed on the tapered portion 30. If the expression (4) is met, a deformation difference will be produced between the inner surface side and the outer surface side of the hollow shell. Therefore, the tensile residual stress on the outer surface of the metal pipe after the cold drawing is reduced. Further, the possibility of an excessive load imposed on the tapered portion 30 can be minimized.

The plug 1 is formed of a well-known material. The material of the plug 1 is, for example, a cemented carbide or tool steel. Further, a hard coating film may be formed on the surface of the plug. In addition, the plug 1 may be of solid-core or hollow-shell.

Figure 3:
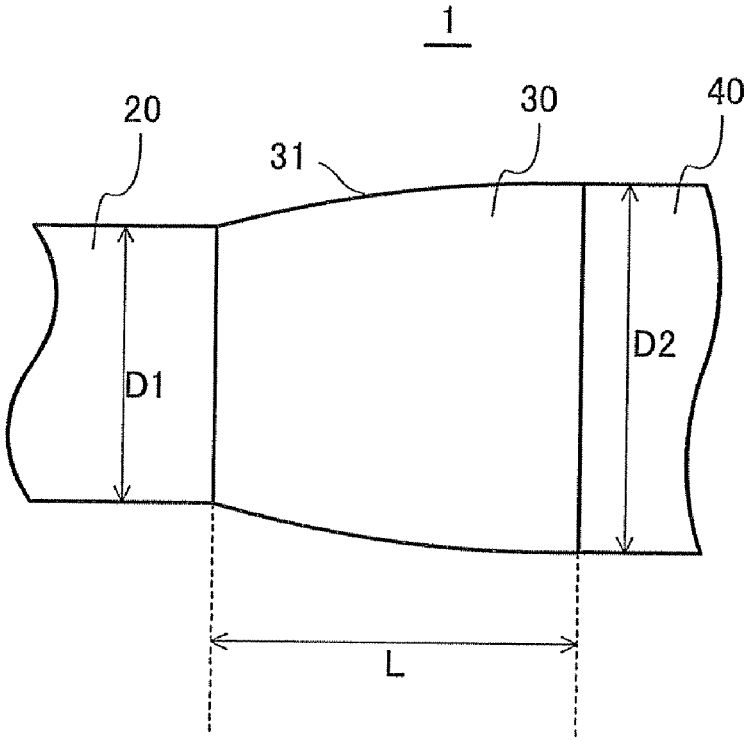
FIG. 3 is a side view of a plug for cold working according to the present embodiment that has a geometry different from that shown in FIG. 1.

In FIG. 1, the tapered surface 31 is drawn as a projection of a truncated cone, however, as shown in FIG. 3, the longitudinal section geometry of the tapered surface 31 may be of a curved line. In a word, so long as the tapered surface 31 has an outside diameter which is gradually increased from the first columnar portion 20 to the second columnar portion 40, the longitudinal section geometry may be either of a straight line or of a curved line.

Figure 4:
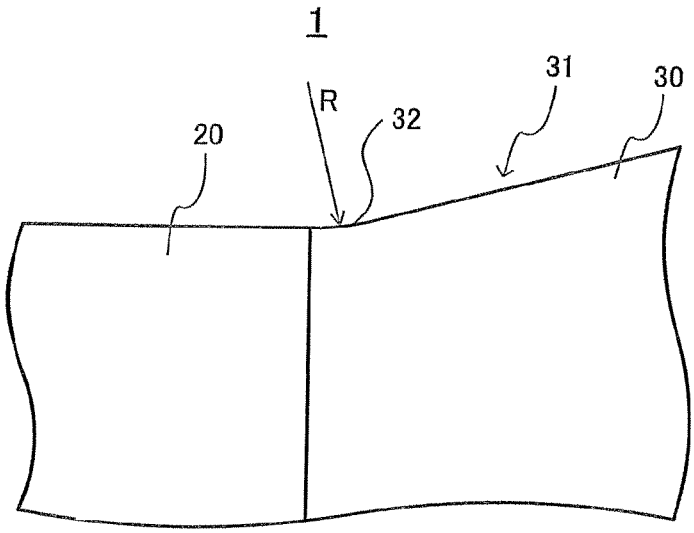
FIG. 4 is a side view of a plug for cold working according to the present embodiment that has a geometry different from that shown in FIGS. 1 and 3.

Preferably, as shown in FIG. 4, a connection portion 32 of the tapered surface 31 that is connected with the first columnar portion 20 is smoothly curved in a concave shape. The connection portion 32 may have a single corner radius as shown in FIG. 4, or a plurality of curvatures. If the connection portion 32 is smoothly curved, the possibility of the plug being damaged if an excessive load is imposed on the connection portion between the first columnar portion 20 and the tapered portion 30 can be minimized.

Method for Manufacturing of Metal Pipe

Figure 5:
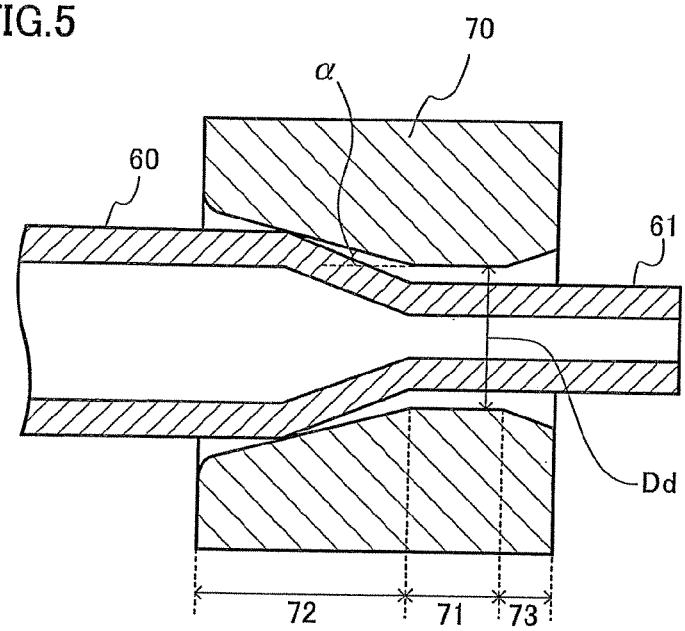
FIG. 5 is a drawing illustrating the first step of the steps for manufacturing of a metal pipe according to the present embodiment.

The method for manufacturing a metal pipe using the above-described plug 1 is as follows. First, a hollow shell is prepared. The hollow shell is manufactured by, for example, hot working. More specifically, the hollow shell may be manufactured by piercing and rolling, or manufactured by hot extrusion or hot forging. Further, the above-mentioned plug 1 and a die 70 as shown in FIG. 5 are prepared. The die 70 is a well-known die, including an approach portion 72, a bearing portion 71, and a relief portion 73. The inside diameter of the approach portion 72 is gradually decreased toward the drawing direction. The inside diameter of the bearing portion 71 is fixed. The inside diameter of the relief portion 73 is gradually increased toward the drawing direction.

The hollow shell prepared is subjected to cold drawing. First, the front end portion of the hollow shell is swaged. Then, as shown in FIG. 5, the front end portion 61 of the hollow shell 60 is inserted into the die 70 which is fixed to a draw bench. After the insertion, the front end portion 61 is gripped with a chuck (not shown) on the draw bench to fix the hollow shell 60.

Figure 6:
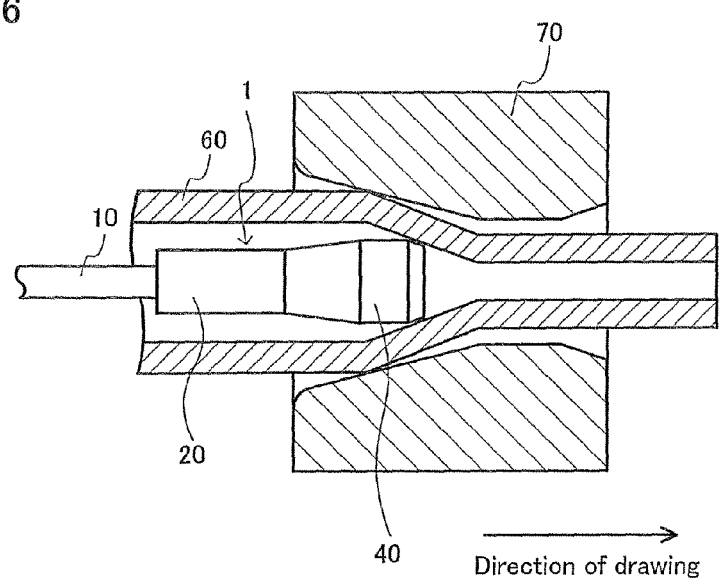
FIG. 6 is a drawing illustrating the second step of the steps for manufacturing of a metal pipe according to the present embodiment.

Next, the plug 1 is mounted to the front end of the rod 10 for supporting the plug. Then, as shown in FIG. 6, the plug 1 is inserted into the hollow shell 60. At this time, the plug 1 is inserted into the hollow shell 60 from the second columnar portion 40 toward the drawing direction.

Figure 7:
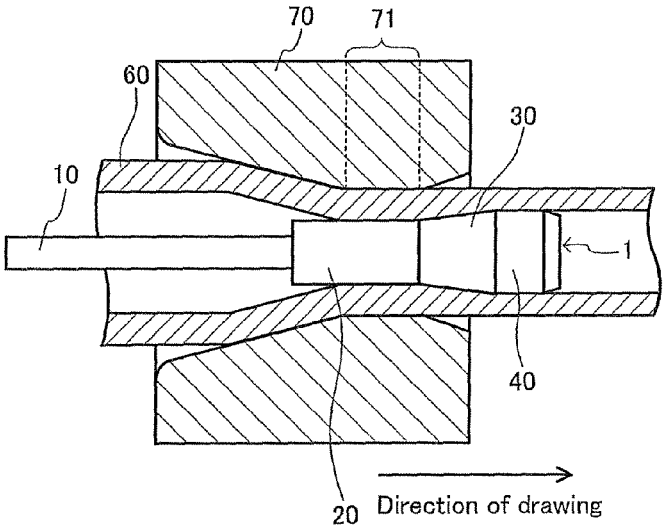
FIG. 7 is a drawing illustrating the third step of the steps for manufacturing of a metal pipe according to the present embodiment.

Then, the hollow shell 60 fixed with the chuck is drawn in the drawing direction. At this time, the plug 1 is pushed on in the drawing direction, and as shown in FIG. 7, the plug 1 is held in a position where the tapered portion 30 is closer to the outlet side than the bearing portion 71 of the die 70. After the plug 1 being held, the hollow shell 60 is drawn to provide a metal pipe. A metal pipe manufactured by taking the above-described steps has a reduced tensile residual stress on the outer surface as compared to that of the metal pipe manufactured by the conventional cold drawing.

The position where the plug 1 is held during cold drawing is not limited to the position shown in FIG. 7. For example, even if the tapered portion 30 is covered by the bearing portion 71 of the die 70, the advantages of the present invention can be effectively obtained. However, the tapered portion 30 of the plug 1 is preferably positioned closer to the outlet side than the bearing portion 71 of the die 70 as shown in FIG. 7. A presumptive reason why it is so is this: if the outer surface of the hollow shell 60 being passed through the tapered portion 30 is not constrained by the bearing portion 71 of the die 70, the difference in deformation between the inner surface side and the outer surface side of the hollow shell 60 under expansion is great, as compared to that if the outer surface of the hollow shell 60 being passed is constrained by the bearing portion 71 of the die 70.

Example 1

The relationship between the plug geometry and the tensile residual stress in a metal pipe after the cold drawing was investigated by the finite element method. Specifically, on the basis of the two-dimensional axis-symmetric elastic-plastic analysis, simulation was performed, and the tensile residual stress $\sigma$ in the circumferential direction on the outer surface of a metal pipe after the cold drawing was calculated.

The outside diameter of a hollow shell, the workpiece, was defined as 55 mm and the wall thickness of the hollow shell was defined as 11.5 mm. The yield stress YS of the hollow shell before cold drawing was defined as 284 MPa. The die used for cold drawing was defined as having the same geometry as that of the die 70 shown in FIG. 5, with the die diameter Dd being defined as 45.1 mm, and the approach angle $2\alpha$ as 25°.

Further, the plurality of plugs which were used for the simulation were defined as having the same geometry as that of the plug 1 shown in FIG. 1, with the dimensions of each plug (the outside diameters D1 and D2, the step height h, the taper half-angle $\theta$, and the axial direction length L) being defined as those given in Table 1.

TABLE 1

| | Plug Geometry | | | | | | | | | |
|---|---|---|---|---|---|---|---|---|---|---|
| Test No. | D2 (mm) | h (mm) | D1 (mm) | θ (°) | L (mm) | L/D2 | ρ | 0.3 × ρ + 0.575 | 0.1 × ρ | σ/YS |
| 1 | 27 | 0.05 | 26.90 | 0.15 | 19.1 | 0.71 | 0.37 | 0.69 | 0.037 | 0.55 |
| 2 | 27 | 0.06 | 26.88 | 0.2 | 17.2 | 0.64 | 0.45 | 0.71 | 0.045 | 0.46 |
| 3 | 27 | 0.10 | 26.80 | 0.3 | 19.1 | 0.71 | 0.75 | 0.80 | 0.075 | 0.40 |
| 4 | 27 | 0.05 | 26.90 | 0.5 | 5.7 | 0.21 | 0.37 | 0.69 | 0.037 | 0.40 |
| 5 | 27 | 0.10 | 26.80 | 0.5 | 11.5 | 0.43 | 0.75 | 0.80 | 0.075 | 0.22 |
| 6 | 27 | 0.20 | 26.60 | 0.5 | 22.9 | 0.85 | 1.50 | 1.03 | 0.150 | 0.53 |
| 7 | 27 | 0.05 | 26.90 | 1.0 | 2.9 | 0.11 | 0.37 | 0.69 | 0.037 | 0.47 |
| 8 | 27 | 0.10 | 26.80 | 1.0 | 5.7 | 0.21 | 0.75 | 0.80 | 0.075 | 0.16 |
| 9 | 27 | 0.20 | 26.60 | 1.0 | 11.5 | 0.43 | 1.50 | 1.03 | 0.150 | 0.14 |
| 10 | 27 | 0.03 | 26.94 | 2.0 | 0.9 | 0.03 | 0.22 | 0.64 | 0.022 | 0.65 |
| 11 | 27 | 0.05 | 26.90 | 2.0 | 1.4 | 0.05 | 0.37 | 0.69 | 0.037 | 0.68 |
| 12 | 27 | 0.10 | 26.80 | 2.0 | 2.9 | 0.11 | 0.75 | 0.80 | 0.075 | 0.44 |
| 13 | 27 | 0.20 | 26.60 | 2.0 | 5.7 | 0.21 | 1.50 | 1.03 | 0.150 | 0.06 |
| 14 | 27 | 0.05 | 26.90 | 4.0 | 0.7 | 0.03 | 0.37 | 0.69 | 0.037 | 0.74 |
| 15 | 27 | 0.10 | 26.80 | 4.0 | 1.4 | 0.05 | 0.75 | 0.80 | 0.075 | 0.81 |
| 16 | 27 | 0.20 | 26.60 | 4.0 | 2.9 | 0.11 | 1.50 | 1.03 | 0.150 | 0.50 |

Using the plug for each test No. in Table 1, the cold drawing was simulated, and the tensile residual stress σ in the circumferential direction on the outer surface of the metal pipe after the cold drawing was calculated. Then, using the yield stress YS (which was 284 MPa) of the hollow shell, the value of σ/YS was determined.

Table 1 gives the results of the simulation. Referring to Table 1, any of the plugs used for the test Nos. 2 to 5, 7 to 9, 12 and 13 met the expressions (1) to (4). Consequently, the tensile residual stress after the cold drawing was small and the value of σ/YS being under 0.5.

On the other hand, the plug used for the test No. 1 did not meet the expression (3). Consequently, the value of σ/YS exceeded 0.5. In the test No. 6, the value of L/D2 exceeded 0.8, not meeting the expression (2). Consequently, the value of σ/YS exceeded 0.5. In the test No. 10, the expansion ratio ρ was under 0.25, not meeting the expression (1). In addition, the value of L/D2 was under 0.06, not meeting the expression (2). Consequently, the value of σ/YS exceeded 0.5. In the test No. 11, the value of L/D2 was under 0.06, not meeting the expression (2). Consequently, the value of σ/YS exceeded 0.5. In the test No. 14 and 15, each of the plugs did not meet the expressions (2) and (4), resulting in the value of σ/YS exceeding 0.5. In the test No. 16, the plug did not meet the expression (4), resulting in the value of σ/YS exceeding 0.5.

Example 2

The cold drawing test using an actual machine was conducted under the conditions given for the test Nos. 21 to 26 in Table 2.

Table 2 shows the results of measurement. Comparing the tensile residual stress in the plug of cylindrical type with that in the plug of the type of the present invention for a metal pipe having given dimensions (a given outside diameter and wall thickness) that was manufactured, the tensile residual stress σ in the plug of the type of the present invention was smaller than that in the plug of cylindrical type. Specifically, the test No. 22 gave a smaller tensile residual stress σ than the test No. 21. Likewise, the test No. 24 gave a smaller tensile residual stress than the test No. 23, and the test No. 26 gave a smaller tensile residual stress than the test No. 25.

Hereinabove, the embodiment of the present invention has been described; however, the above-described embodiment is merely illustrative examples for carrying out the present invention. Therefore, the present invention is not limited to the above-described embodiment, and may be carried out with an appropriate change of the above-described embodiment without departing from the scope and spirit of the present invention.

The invention claimed is:

1. A plug for use in cold drawing of a metal pipe, comprising:

a first columnar portion having an outside diameter D1;

a second columnar portion formed coaxially with the first columnar portion and having an outside diameter D2 larger than the outside diameter D1; and a tapered portion formed between the first columnar portion and the second columnar portion and having a tapered surface provided with an outside diameter gradually increasing from the first columnar portion to the second columnar portion and an axial direction length L, the outside diameters D1 and D2, and the axial direction length L meeting the following expressions (1) to (4):

$$0.25 \leqq \rho \leqq 2.00 \quad (1),$$

$$0.06 \leqq L/D2 \leqq 0.8 \quad (2),$$

$$L/D2 \leqq 0.3 \times \rho + 0.575 \quad (3), \text{ and}$$

$$L/D2 \geqq 0.1 \times \rho \quad (4)$$

where $\rho = (D2 - D1)/D1 \times 100$.

TABLE 2

| | Plug Geometry | | | | | | | | | | Die Geometry | | Metal Pipe Geometry | | Tensile |
|---|---|---|---|---|---|---|---|---|---|---|---|---|---|---|---|
| Test No. | Type | D2 (mm) | h (mm) | D1 (mm) | θ (°) | L (mm) | L/D2 | ρ | 0.3 × ρ + 0.575 | 0.1 × ρ | Die Bore Diameter Dd (mm) | Approach Angle 2α (°) | OD (mm) | Wall Thickness (mm) | Residual Stress σ (MPa) |
| 21 | Cylindrical | 27.0 | — | — | — | — | — | — | — | — | 45.1 | 25 | 45.1 | 9.05 | 173 |
| 22 | Of present invention | 27.0 | 0.10 | 26.8 | 1.0 | 5.7 | 0.21 | 0.75 | 0.80 | 0.075 | 45.1 | 25 | 45.1 | 9.05 | 77 |
| 23 | Cylindrical | 26.6 | — | — | — | — | — | — | — | — | 57.1 | 25 | 57.1 | 15.25 | 282 |
| 24 | Of present invention | 26.6 | 0.10 | 26.4 | 1.0 | 5.7 | 0.21 | 0.75 | 0.80 | 0.075 | 57.1 | 25 | 57.1 | 15.25 | 137 |
| 25 | Cylindrical | 25.3 | — | — | — | — | — | — | — | — | 48.7 | 25 | 48.7 | 11.7 | 180 |
| 26 | Of present invention | 25.3 | 0.10 | 25.1 | 1.0 | 5.7 | 0.23 | 0.79 | 0.81 | 0.079 | 48.7 | 25 | 48.7 | 11.7 | 68 |

Plugs of two types of geometry were prepared; they were of conventional cylindrical type of plug geometry and of the type of plug geometry of the present invention as shown in FIG. 1. The plugs of cylindrical type of plug geometry had outside diameters given in the column D2 in Table 2. The plugs of the type of plug geometry of the present invention had dimensions of D2, D1, h, θ, and L shown in Table 2, with any of them meeting the expressions (1) to (4). In the test of a particular test No., a tapered die having a die diameter Dd and an approach angle 2α given in Table 2 for the test No. was used.

Using the above-described dies and plugs, hollow shells were cold-drawn to produce metal pipes. The metal pipes after the cold drawing had outside diameters and wall thicknesses given in Table 2. The tensile residual stress σ (MPa) in the circumferential direction on the outer surface of the metal pipe after the cold drawing was measured by use of X rays.

2. The plug for cold drawing of claim 1, wherein a connection portion of the tapered surface that is connected with an end edge of the first columnar portion is smoothly curved in a concave shape.

3. A method for manufacturing of a metal pipe, comprising the steps of:

preparing a plug for cold drawing including a first columnar portion having an outside diameter D1; a second columnar portion formed coaxially with the first columnar portion and having an outside diameter D2 larger than the outside diameter D1; and a tapered portion formed between the first columnar portion and the second columnar portion and having a tapered surface provided with an outside diameter gradually increasing from the first columnar portion to the second columnar portion and an axial direction length L, the outside diameters D1 and D2, and the axial direction length L meeting the following expressions (1) to (4), and a die for cold drawing:

$$0.25 \leqq \rho \leqq 2.00 \quad (1),$$

$$0.06 \leqq L/D2 \leqq 0.8 \quad (2),$$

$$L/D2 \leqq 0.3 \times \rho + 0.575 \quad (3), \text{ and}$$

$$L/D2 \geqq 0.1 \times \rho \quad (4)$$

where $\rho = (D2 - D1)/D1 \times 100$;

inserting one end of a hollow shell into the die;

inserting the plug for cold drawing into the hollow shell from the second columnar portion toward the direction of drawing; and drawing the hollow shell while holding the plug for cold drawing at a predetermined position.

4. The method for manufacturing of a metal pipe of claim 3, wherein a connection portion of the tapered surface of the plug for cold drawing that is connected with an end edge of the first columnar portion is smoothly curved in a concave shape.

* * * * *